US008549859B2

(12) United States Patent
Fox et al.

(10) Patent No.: US 8,549,859 B2
(45) Date of Patent: Oct. 8, 2013

(54) COMBUSTOR APPARATUS IN A GAS TURBINE ENGINE

(75) Inventors: Timothy A. Fox, Ontario (CA); David J. Wiebe, Orlando, FL (US); David M. Ritland, Winter Park, FL (US); John Carl Glessner, Kings Mills, OH (US)

(73) Assignee: Siemens Energy, Inc., Orlando, FL (US)

( * ) Notice: Subject to any disclaimer, the term of this patent is extended or adjusted under 35 U.S.C. 154(b) by 1206 days.

(21) Appl. No.: 12/233,903

(22) Filed: Sep. 19, 2008

(65) Prior Publication Data

US 2010/0018210 A1 Jan. 28, 2010

Related U.S. Application Data

(63) Continuation-in-part of application No. 12/180,657, filed on Jul. 28, 2008.

(51) Int. Cl.
*F02C 7/22* (2006.01)

(52) U.S. Cl.
USPC ..... 60/733; 60/760

(58) Field of Classification Search
USPC ..... 60/737–740, 743, 752, 755–758, 760, 60/796, 733
See application file for complete search history.

(56) References Cited

U.S. PATENT DOCUMENTS

| | | | | |
|---|---|---|---|---|
| 2,920,449 | A | 1/1960 | Johnson et al. | |
| 3,775,975 | A | 12/1973 | Stenger et al. | |
| 3,982,392 | A * | 9/1976 | Crow | 60/39.23 |
| 4,719,748 | A | 1/1988 | Davis, Jr. et al. | |
| 4,928,481 | A | 5/1990 | Joshi et al. | |
| 5,069,029 | A | 12/1991 | Kuroda et al. | |
| 5,177,955 | A * | 1/1993 | Shekleton | 60/804 |
| 5,323,600 | A | 6/1994 | Munshi | |
| 5,454,221 | A | 10/1995 | Loprinzo | |
| 5,487,275 | A | 1/1996 | Borkowicz et al. | |
| 5,575,154 | A | 11/1996 | Loprinzo | |
| 5,687,572 | A | 11/1997 | Schrantz et al. | |
| 5,737,915 | A | 4/1998 | Lin et al. | |
| 5,937,653 | A | 8/1999 | Alary et al. | |
| 6,047,550 | A | 4/2000 | Beebe | |
| 6,065,282 | A | 5/2000 | Fukue et al. | |

(Continued)

FOREIGN PATENT DOCUMENTS

| | | | |
|---|---|---|---|
| DE | 10154285 | A1 | 5/2003 |
| EP | 1400754 | A1 | 3/2004 |

OTHER PUBLICATIONS

U.S. Appl. No. 12/180,637, filed Jul. 28, 2008, entitled Intergral Flow Sleeve and Fuel Injector Assembly.

(Continued)

*Primary Examiner* — Andrew Nguyen

(57) ABSTRACT

A combustion apparatus in a gas turbine engine comprises a combustor shell for receiving air, a fuel injection system associated with the combustor shell, a first fuel supply structure, and a shield structure. The fuel supply structure is in fluid communication with a source of fuel for delivering fuel from the source of fuel to the fuel injection system and comprises a first fuel supply elements including a first section extending along a first path having a component in an axial direction and a second section extending from the first section along a second path having a component in a circumferential direction. The shield structure is associated with at least a portion of the second section of the first fuel supply element.

20 Claims, 7 Drawing Sheets

(56) References Cited

U.S. PATENT DOCUMENTS

| | | | | |
|---|---|---|---|---|
| 6,109,038 | A * | 8/2000 | Sharifi et al. | 60/737 |
| 6,487,860 | B2 | 12/2002 | Mayersky et al. | |
| 6,513,334 | B2 * | 2/2003 | Varney | 60/776 |
| 6,796,130 | B2 | 9/2004 | Little et al. | |
| 6,843,061 | B2 | 1/2005 | Parker et al. | |
| 6,848,260 | B2 | 2/2005 | North et al. | |
| 6,883,332 | B2 | 4/2005 | Steinthorsson et al. | |
| 6,996,991 | B2 | 2/2006 | Gadde et al. | |
| 7,028,483 | B2 | 4/2006 | Mansour et al. | |
| 7,080,515 | B2 | 7/2006 | Wasif et al. | |
| 7,082,770 | B2 | 8/2006 | Martling et al. | |
| 7,117,679 | B2 | 10/2006 | Toon et al. | |
| 7,249,461 | B2 | 7/2007 | Moraes | |
| 7,546,739 | B2 | 6/2009 | Holland et al. | |
| 2004/0055306 | A1 | 3/2004 | North et al. | |
| 2005/0039457 | A1 | 2/2005 | Moraes | |
| 2006/0101801 | A1 | 5/2006 | Bland | |
| 2006/0283189 | A1 | 12/2006 | Lipinski et al. | |
| 2007/0012043 | A1 | 1/2007 | Parker et al. | |
| 2007/0130958 | A1 | 6/2007 | Ohri et al. | |
| 2007/0157616 | A1 | 7/2007 | Hernandez et al. | |
| 2007/0220898 | A1 | 9/2007 | Hessler | |
| 2007/0234724 | A1 * | 10/2007 | Prociw et al. | 60/740 |
| 2008/0083225 | A1 * | 4/2008 | Fish et al. | 60/772 |

OTHER PUBLICATIONS

U.S. Appl. No. 12/180,657, filed Jul. 28, 2008, entitled Turbine Engine Flow Sleeve.

L.B. Davis and S.H. Black; Dry Low NOx Combusion Systems for GE Heavy-Duty Gas Turbines, GE Power Systems GER-3568G article, Oct. 2000, pp. 1-22, USA.

* cited by examiner

COMBUSTOR APPARATUS IN A GAS TURBINE ENGINE

CROSS REFERENCE TO RELATED APPLICATION

This application is A CONTINUATION-IN-PART APPLICATION of and claims priority to U.S. patent application Ser. No. 12/180,657, filed on Jul. 28, 2008, entitled "TURBINE ENGINE FLOW SLEEVE," the entire disclosure of which is incorporated by reference herein.

FIELD OF THE INVENTION

The present invention relates to a combustor apparatus in a gas turbine engine comprising a fuel supply structure coupled to a fuel injection system and, more particularly, to a fuel supply structure having a shape that allows it to expand during operation of the gas turbine engine.

BACKGROUND OF THE INVENTION

In gas turbine engines, fuel is delivered from a source of fuel to a combustion section where the fuel is mixed with air and ignited to generate hot combustion products defining working gases. The working gases are directed to a turbine section. The combustion section may comprise one or more stages, each stage supplying fuel to be ignited. It has been found that the production of NOx gases from the burning fuel can be reduced by providing fuel downstream from the main combustion zone. A prior art method of delivering fuel to the downstream section of the combustion section includes providing "pig-tailed" fuel supply tubes. Such tubes are undesirable as they take up space in the combustion section and are subject to being buffeted by the high velocity air that flows across them.

SUMMARY OF THE INVENTION

In accordance with a first embodiment of the present invention, a combustion apparatus is provided in a gas turbine engine. The combustion apparatus comprises a combustor shell for receiving compressed air, a first fuel injection system associated with the combustor shell, a first fuel supply structure, a second fuel injection system associated with the combustor shell, a second fuel supply structure, and a shield structure. The first fuel supply structure is in fluid communication with a source of fuel for delivering fuel from the source of fuel to the first fuel injection system. The second fuel supply structure is in fluid communication with the source of fuel for delivering fuel from the source of fuel to the second fuel injection system. The second fuel supply structure comprises a fuel supply element including a first section extending along a first path having a component in an axial direction and a second section extending from the first section along a second path having a component in a circumferential direction. The shield structure is associated with at least a portion of the second section of the fuel supply element to substantially shield the second section portion of the fuel supply element from compressed air.

The first section may be located between the source of fuel and the second section.

The fuel supply element may comprise a third section located downstream of the second section. The third section may extend along a third path having a component in the axial direction.

The first section path may extend substantially in the axial direction and the second section path may extend substantially in the circumferential direction. The second section path may extend about 90 degrees from the first section path and through an arc of from about 15 degrees to about 180 degrees.

The shield structure may extend at least partially around the combustor shell and may define a casing having an inner cavity for receiving at least the portion of the second section of the fuel supply element.

The shield structure may be separately formed from the combustor shell or integrally formed with the combustor shell.

The shield structure may comprise an annular shape.

The second fuel injection system may be positioned in a downstream portion of the combustor shell.

The first fuel injection system may be positioned in an upstream portion of the combustor shell.

The shield structure may provide structural support to the fuel supply element second section so as to reduce vibrations occurring in the fuel supply element.

At least one fastener may be provided to secure the fuel supply element to the shield structure.

In accordance with a second embodiment of the invention, a combustion apparatus is provided in a gas turbine engine. The combustion apparatus comprises a combustor shell for receiving compressed air, a fuel injection system associated with the combustor shell, a fuel supply structure, and a shield structure. The fuel supply structure is in fluid communication with a source of fuel for delivering fuel from the source of fuel to the fuel injection system. The fuel supply structure comprises a fuel supply element including a first section extending along a first path having a component in an axial direction and a second section extending from the first section along a second path having a component in a circumferential direction. The shield structure is associated with at least a portion of the second section of the fuel supply element.

In accordance with a third embodiment of the invention, a combustion apparatus is provided in a gas turbine engine. The combustion apparatus comprises a combustor shell for receiving compressed air, a fuel injection system that distributes fuel to a location that is downstream from a main combustion zone, and a fuel supply structure. The fuel supply structure is in fluid communication with a source of fuel for delivering fuel from the source of fuel to the fuel injection system. The fuel supply structure comprises a fuel supply element including a first section extending along a first path having a component in an axial direction and a second section extending from the first section along a second path having a component in a circumferential direction. The second section path extends only through an arc of from about 15 degrees to about 180 degrees.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
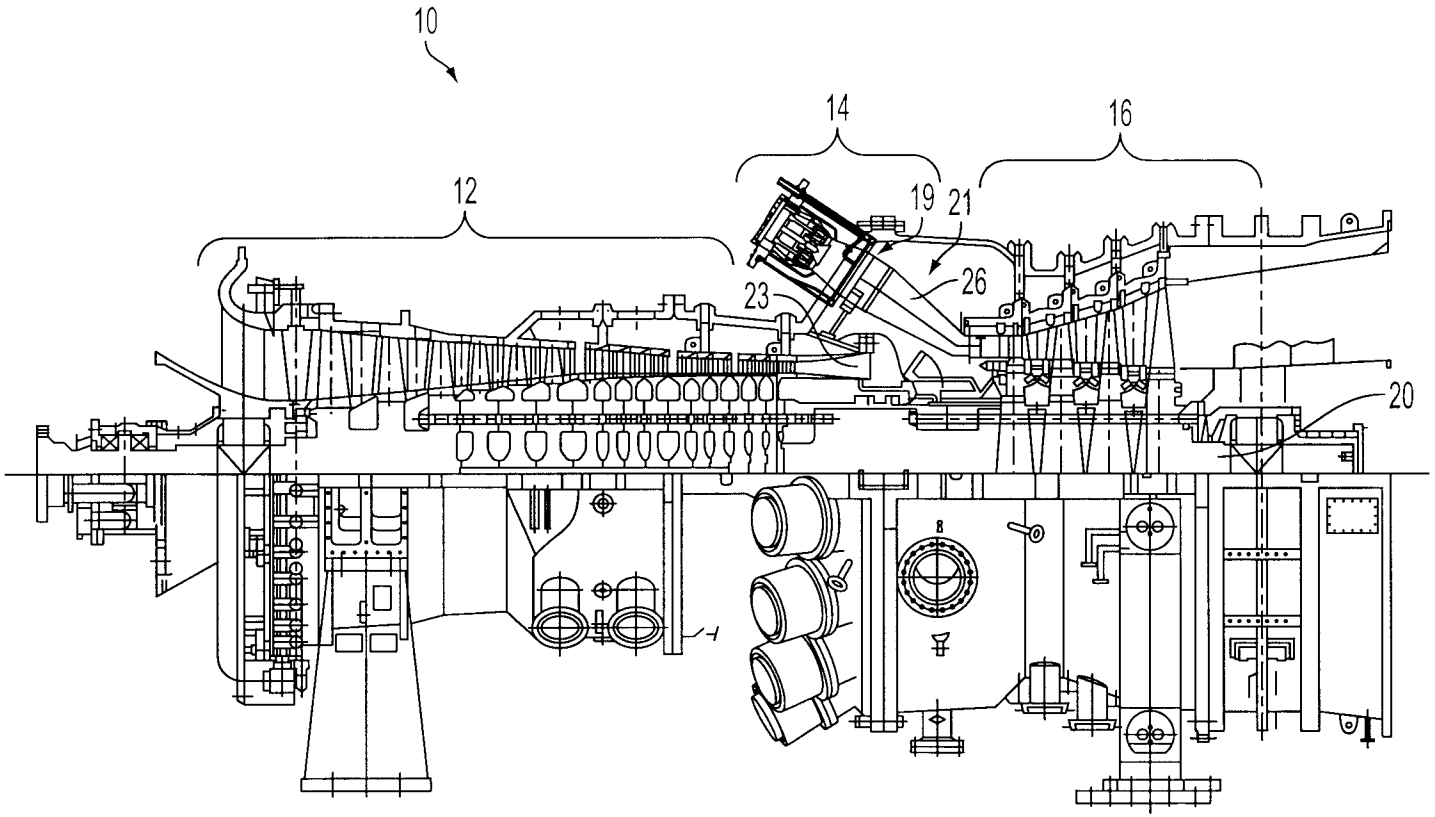
FIG. 1 is a sectional view of a gas turbine engine including a plurality of combustors according to an embodiment of the invention.

Referring to FIG. 1, a gas turbine engine 10 is shown. The engine 10 includes a compressor section 12, a combustion section 14 including a plurality of combustors 13, also referred to herein as "combustion apparatuses," and a turbine section 16. The compressor section 12 inducts and pressurizes inlet air which is directed to the combustors 13 in the combustion section 14. Upon entering the combustors 13, the compressed air from the compressor section 12 is pre-mixed with a fuel in a pre-mixing passage 18 (see FIG. 2). The pre-mixed fuel and air then flows into a combustion chamber 14A where it is mixed with fuel from one or more main fuel injectors 15 and a pilot fuel injector 17 (see FIG. 2) and ignited to produce a high temperature combustion gas flowing in a turbulent manner and at a high velocity. The main and pilot fuel injectors 15, 17 are also referred to herein as "a first fuel injection system." The structure 11 for supplying fuel to the main and pilot fuel injectors 15, 17 from a fuel source is referred to herein as "a first fuel supply structure." The combustion gas then flows through a transition 26 to the turbine section 16 where the combustion gas is expanded to provide rotation of a turbine rotor 20 as shown in FIG. 1.

Figure 2:
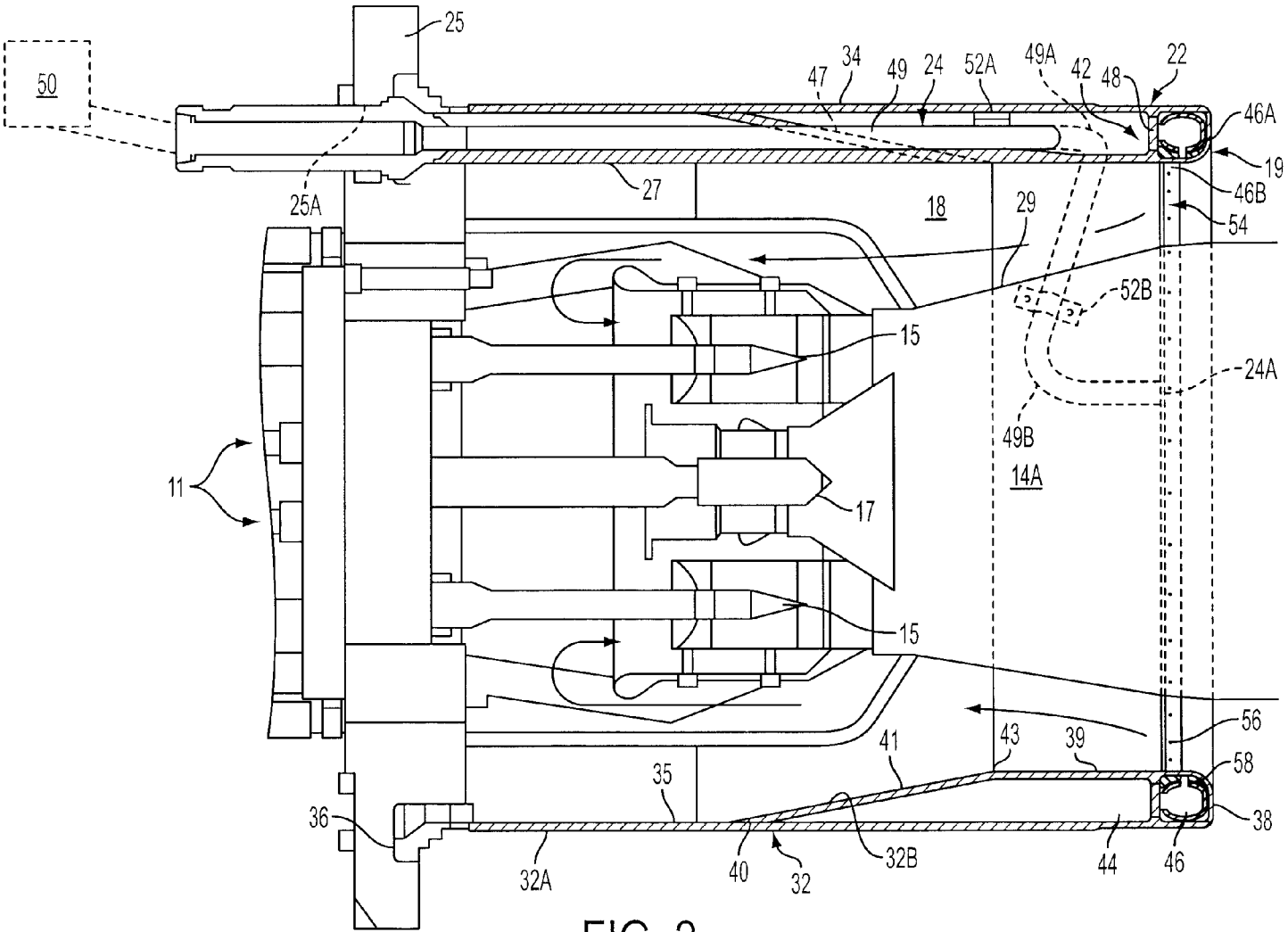
FIG. 2 is a side cross sectional view of one of the combustors shown FIG. 1.

Referring to FIG. 2, the pre-mixing passage 18 is defined by a pre-mix fuel injector assembly 19, also referred to herein as "a fuel injection system" or "a second fuel injection system," comprising a flow sleeve 22, also referred to herein as "a combustor shell," surrounding a liner 29 of the combustion chamber 14A. The flow sleeve 22 may have a generally cylindrical configuration and may comprise an annular sleeve wall 32 that defines the pre-mixing passage 18 between the sleeve wall 32 and the liner 29. The flow sleeve 22 may be manufactured in any manner, such as, for example, by a casting procedure. Further, the sleeve wall 32 may comprise a single piece or section of material or a plurality of joined individual pieces or sections, and may be formed from any material capable of operation in the high temperature and high pressure environment of the combustion section 14 of the engine 10, such as, for example, stainless steel or carbon steel, and in a preferred embodiment comprises a steel alloy including chromium.

As shown in FIG. 2, the sleeve wall 32 includes a radially outer surface 34, a radially inner surface 35, a forward end 36, and an aft end 38 opposed from the forward end 36. The forward end 36 is affixed to a cover plate 25, i.e., with bolts (not shown). The aft end 38 defines an air inlet from a combustor plenum 21 (see FIG. 1), which receives the compressed air from the compressor section 12 via a compressor section exit diffuser 23 (see FIG. 1). The radially outer surface 34 is defined by a substantially cylindrical first wall section 32A that extends axially between the forward end 36 and the aft end 38. In the embodiment shown, the radially inner surface 35 is partially defined by the first wall section 32A and is partially defined by a second wall section 32B. The second wall section 32B comprises a conical shaped portion 41 and cylindrical shaped portion 39. The second wall section 32B is affixed to and extends from the first wall section 32A at an interface 40, as may be further seen in FIG. 2A. The second wall section 32B may be affixed to the first wall section 32A by any conventional means, such as by welding.

Figure 2A:
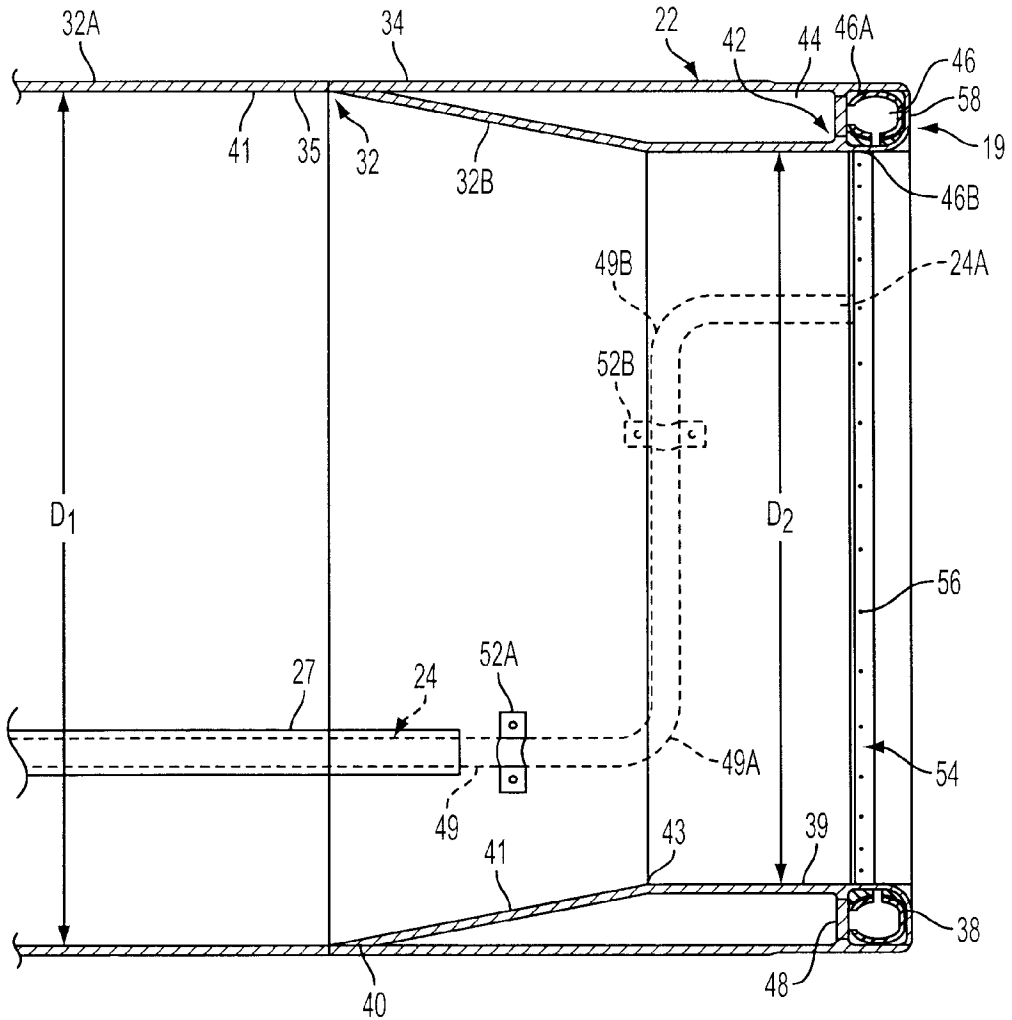
FIG. 2A is a side cross sectional view of the pre-mix fuel injector assembly illustrated in FIG. 2 shown removed from the combustor.

As seen in FIGS. 2 and 2A, the conical portion 41 of the second wall section 32B defines a transition between two inner diameters of the sleeve wall 32 extending axially between the forward end 36 and the aft end 38. Specifically, the conical portion 41 transitions between a first, larger inner diameter $D_1$, located adjacent to the forward end 36, and a second, smaller inner diameter $D_2$, located adjacent to the aft end 38 (see FIG. 2A). It is understood that the sleeve wall 32 may have a substantially constant diameter if desired, or the diameter $D_2$ of the aft end 38 could be greater than the diameter $D_1$ of the forward end 36.

Referring to FIGS. 2 and 2A, a cavity 42 is defined in the sleeve wall 32 adjacent to the sleeve wall aft end 38 between the first and second wall sections 32A, 32B. In the preferred embodiment, the cavity 42 comprises a first portion defining a transition chamber 44 and a second portion defining an annular fuel supply chamber 46, but may comprise any number of portions, including a single portion.

In the illustrated embodiment, the fuel supply chamber 46 is separated from the transition chamber 44 by a web member 48 extending radially between the first and second wall sections 32A, 32B and dividing the cavity 42 into the transition chamber 44 and the fuel supply chamber 46. It should be noted that although the web member 48 is illustrated as comprising a separate piece of material attached to the first and second wall sections 32A, 32B, the web member 48 could also be provided as integral with either or both of the first and second wall sections 32A, 32B of the sleeve wall 32.

The annular fuel supply chamber 46 comprises an annular channel 46A formed in the sleeve wall 32 and defines a fuel flow passageway for supplying fuel around the circumference of the sleeve wall 32 for distribution to the pre-mixing passage 18. The annular channel 46A may be formed in the sleeve wall 32 by any suitable method, such as, for example, by bending or forming the end of the sleeve wall 32 or by machining the annular channel 46A into the sleeve wall 32. In the embodiment shown, the annular channel 46A preferably extends circumferentially around the entire sleeve wall 32, but may extend around only a selected portion of the sleeve wall 32. Optionally, the fuel supply chamber 46 may be provided with a thermally resistant sleeve 58 therein, i.e., a sleeve formed of a material having a high thermal resistance. Additional description of the annular channel 46A and the thermally resistant sleeve 58 may be found in U.S. patent application Ser. No. 12/180,637, filed on Jul. 28, 2008 entitled "INTEGRAL FLOW SLEEVE AND FUEL INJECTOR ASSEMBLY," the entire disclosure of which is incorporated by reference herein.

Referring to FIG. 2, the flow sleeve 22 further comprises a fuel feed passageway 24 provided for receiving a fuel supply tube 49, which tube 49 is also referred to herein as "a fuel supply structure" or "a second fuel supply structure" and also defines a "fuel supply element," that is in fluid communication with a source of fuel 50 and extends through an aperture 25A in the cover plate 25. As may be further seen in FIG. 2A, the fuel feed passageway 24 is defined by a U-shaped cover structure 27 that is affixed to the inner surface 35 of the sleeve wall 32, such as by welding, for example, and is further defined by a slot or opening 47 (FIG. 2) defined in the second wall section 32B at the conical portion 41. The cover structure 27 isolates the fuel supply tube 49 from the hot gases flowing through the pre-mixing passage 18 by substantially preventing the hot gases from entering the fuel feed passageway 24. Hence, the fuel supply tube 49 provides fluid communication for conveying fuel between the source of fuel 50 and the fuel supply chamber 46 of the cavity 42 by passing through the aperture 25A in the cover plate 25, through the fuel feed passageway 24, including the opening 47, and through the transition chamber 44 of the cavity 42. The U-shaped cover structure 27 and the first and second wall sections 32A, 32B defining the transition chamber 44 are also referred to herein as "shield structure."

Referring to FIG. 2A, the fuel supply tube 49 is affixed to the web member 48, for example, by welding, such that a fluid outlet 24A of the fuel supply tube 49 is in fluid communication with the fuel supply chamber 46 of the cavity 42 via an aperture 48A formed in the web member 48. Preferably, as most clearly shown in FIG. 2A, the fuel supply tube 49 may include a series of bends 49A, 49B or circumferential direction shifts within the transition chamber 44 of the cavity 42, so as to provide the fuel supply tube 49 with an S-shape. As shown in FIG. 2A, the S-shaped fuel supply tube has a first section extending along a first path having a component in an axial direction, a second section extending along a second path having a component in a circumferential direction, and a third section extending along a third path having a component in the axial direction. The bends 49A, 49B may reduce stress to the fuel supply tube 49 caused by a thermal expansion and contraction of the fuel supply tube 49 and the flow sleeve 22 during operation of the engine 10, accommodating relative movement between the fuel supply tube 49 and the sleeve wall 32, such as may result from thermally induced movement of one or both of the fuel supply tube 49 and sleeve wall 32. The fuel supply tube 49 may be secured to the sleeve wall 32 at various locations with fasteners 52A, 52B, illustrated herein by straps, as seen in FIGS. 2 and 2A. It should be understood that other types of fasteners, allowing any combination of free and constrained degrees of freedom could be used and could be employed in different locations than those illustrated in FIGS. 2 and 2A.

Referring to FIGS. 2 and 2A, a fuel dispensing structure 54 is associated with the annular channel 46A and, in the preferred embodiment, comprises an annular segment 46B of the sleeve wall 32 adjacent the aft end 38. In the embodiment shown, the annular segment 46B is provided as a separate element affixed in sealing engagement over the annular channel 46A to form a radially inner boundary for the annular channel 46A, and is configured to distribute fuel into the pre-mixing passage 18. For example, the annular segment 46B may be welded to the sleeve wall 32 at first and second welds (not shown) on opposed sides of the annular channel 46A at an interface between the annular segment 46B and the sleeve wall 32 to create a substantially fluid tight seal with the sleeve wall 32. It should be noted that other means may be provided for affixing the annular segment 46B to the sleeve wall 32 and that the annular segment 46B of the fuel dispensing structure 54 could be formed integrally with the sleeve wall 32. The fuel dispensing structure 54 is further described in the above-noted U.S. patent application Ser. No. 12/180,637.

The fuel dispensing structure 54 further includes a plurality of fuel distribution apertures 56 formed in the annular segment 46B. In a preferred embodiment, the fuel distribution apertures 56 comprise an annular array of openings or through holes extending through the annular segment 46B. The fuel distribution apertures 56 may be substantially equally spaced in the circumferential direction, or may be configured in other patterns as desired, such as, for example, a random pattern. The fuel distribution apertures 56 are adapted to deliver fuel from the fuel supply chamber 46 to the pre-mixing passage 18 at predetermined circumferential locations about the flow sleeve 22 during operation of the engine 10. The number, size and locations of the fuel distribution apertures 56, as well as the dimensions of the fuel supply chamber 46, are preferably configured to deliver a predetermined flow of fuel to the pre-mixing passage 18 for pre-mixing the fuel with incoming air as the air flows to the combustion chamber 14A.

Since the cover structure 27 is formed integrally with the flow sleeve 22, the possibility of damage to the fuel supply tube 49, which may occur during manufacturing, maintenance, or operation of the engine 10, for example, may be reduced by the present design. Further, the cover structure 27 and the transition chamber 44 of the cavity 42 prevent direct contact and provide a barrier for the fuel supply tube 49 from vibrations that would otherwise be imposed on the fuel supply tube 49 by the gases flowing through the pre-mixing passage 28. Accordingly, damage caused to the fuel supply tube 49 by such vibrations is believed to be avoided by the current design.

Moreover, the aft end 38 of the sleeve wall 32 provides a relatively restricted flow area at the entrance to the pre-mixing passage 18 and expands outwardly in the flow direction producing a venturi effect, i.e., a pressure drop, inducing a higher air velocity in the area of the fuel dispensing structure 54. The higher air velocity in the area of the fuel dispensing structure 54 facilitates heat transfer away from the liner 29 and substantially prevents flame pockets from forming between the sleeve wall 32 and the liner 29, which could result in flames attaching to and burning holes in the sleeve wall 32, the liner 29, and/or any other components in the vicinity. Further, while the pressure drop provided at the aft end 38 of the sleeve wall 32 is sufficient to obtain the desired air velocity increase adjacent to the fuel dispensing structure 54, a substantial pressure is maintained along the length of the flow sleeve 22 in order to limit the production of $NO_x$ in the fuel/air mixture between the sleeve wall 32 and the liner 29.

The web member 48 located at the aft end 38 of the sleeve wall 32 forms an I-beam structure with the first and second wall sections 32A, 32B to strengthen and substantially increase the natural frequency of the flow sleeve 22 away from the operating frequency of the combustor 13. For example, the operating frequency of the combustor 13 may be approximately 300 Hz, and the natural frequency of the flow sleeve 22 is increased by the I-beam stiffening structure to approximately 450 HZ. Hence, damaging resonant frequencies in the flow sleeve 22 are substantially avoided by the increase in the natural frequency provided by the present construction.

Figure 3:
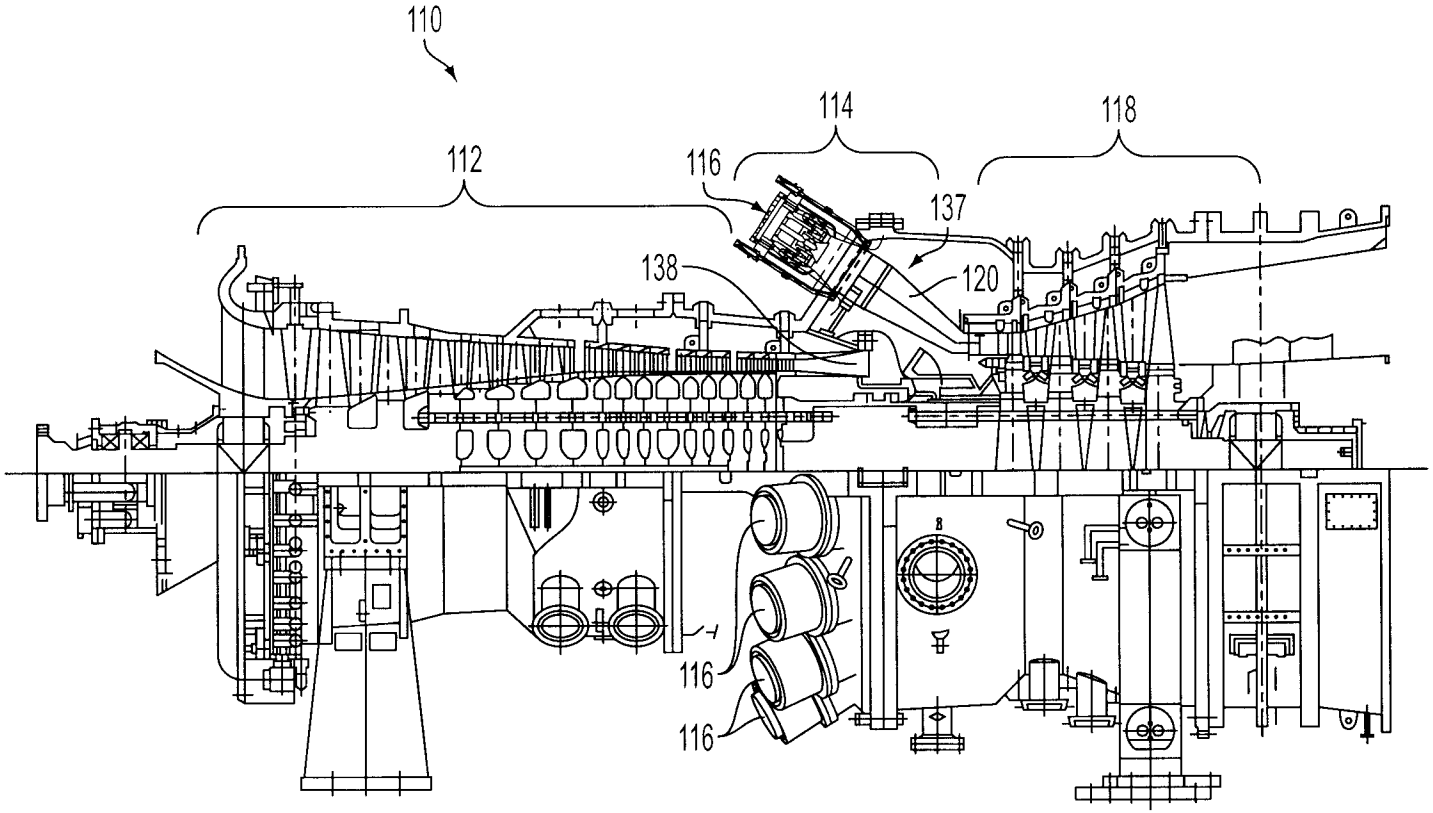
FIG. 3 is a sectional view of a gas turbine engine including a plurality of combustors having fuel supply systems according to another embodiment of the invention.

A portion of a can-annular combustion system 114, constructed in accordance with a further embodiment of the present invention, is illustrated in FIG. 3. The combustion system 114 forms part of a gas turbine engine 110. The gas turbine engine 110 further comprises a compressor 112 and a turbine 118. Air enters the compressor 112, where it is compressed to an elevated pressure and delivered to the combustion system 114, where the compressed air is mixed with fuel and burned to create hot combustion products defining a working gas. The working gases are routed from the combustion system 114 to the turbine 118. The working gases expand in the turbine 118 and cause blades coupled to a shaft and disc assembly to rotate.

The can-annular combustion system 114 comprises a plurality of combustor apparatuses 116 and a like number of corresponding transition ducts 120. The combustor apparatuses 116 and transition ducts 120 are spaced circumferentially apart so as to be positioned within and around an outer shell or casing 110A of the gas turbine engine 10. Each transition duct 120 receives combustion products from its corresponding combustor apparatus 116 and defines a path for those combustion products to flow from the combustor apparatus 116 to the turbine 118.

Figure 4:
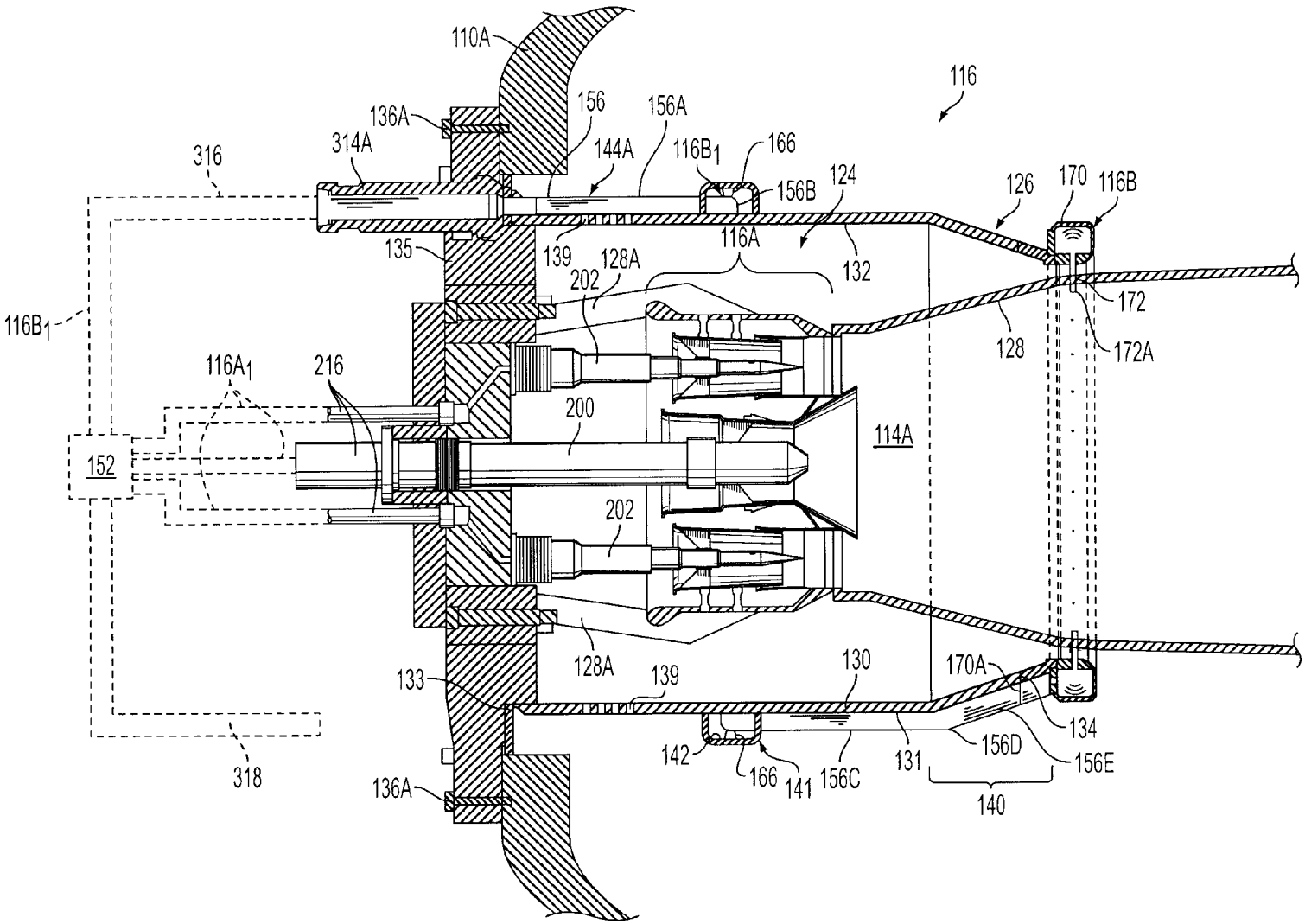
FIG. 4 is a side cross sectional view of one of the combustors illustrated in FIG. 3 incorporating a fuel supply system according to an embodiment of the invention.

Only a single combustor apparatus 116 is illustrated in FIG. 4. Each of the combustor apparatuses 116 forming part of the can-annular combustion system 114 may be constructed in the same manner as the combustor apparatus 116 illustrated in FIG. 4. Hence, only the combustor apparatus 116 illustrated in FIG. 4 will be discussed in detail here.

The combustor apparatus 116 comprises a combustor shell 126 coupled to the outer casing 110A of the gas turbine engine 110 via a cover plate 135, see FIG. 4. The combustor apparatus 116 further comprises a liner 128 coupled to the cover plate 135 via supports 128A, a first fuel injection system 116A, first fuel supply structure 116$A_1$, a second fuel injection system 116B and second fuel supply structure 116$B_1$. The combustor shell 126 may comprise an annular shell wall 130. An air flow passage 124 is defined between the shell wall 130 and the liner 128 and extends up to the cover plate 135.

As shown in FIG. 4, the shell wall 130 includes a radially outer surface 131, a radially inner surface 132, a forward end 133, and an aft end 134 opposite the forward end 133. The forward end 133 is affixed to the cover plate 135 of the engine 110, i.e., with bolts (not shown). The cover plate 135 is coupled to the outer casing 110A via bolts 136A, see FIG. 4. The aft end 134 defines a first inlet into the air flow passage 124. Compressed air generated by the compressor 112 passes through an exit diffuser 138 and combustor plenum 137 prior to passing through the aft end 134 into the air flow passage 124, see FIG. 3.

In the illustrated embodiment, the shell wall 130 comprises a plurality of apertures 139 defining a second inlet into the air flow passage 124. Further compressed air generated by the compressor 112 passes from outside the shell wall 130 into the air flow passage 124 via the apertures 139. It is understood that the percentage of air that passes into the air flow passage 124 through the apertures 139 versus that which passes through the first inlet defined by the aft end 134 of the shell wall 130 can be configured as desired. For example, 100% of the air may pass into the air flow passage 124 at the first inlet defined by the aft end 134, in which case the apertures 139 would not be necessary. Or, nearly all of the air may pass into the air flow passage 124 through the apertures 139, although it is understood that other configurations could exist. The apertures 139 are designed, for example, to condition and/or regulate the flow around the circumference of the shell wall 130 such that if it is found that more/less air is needed at a certain circumferential location, then the apertures 139 at that location could be enlarged/reduced in size and apertures 139 in other locations could be reduced/enlarged in size accordingly. It is contemplated that the apertures 139 may be arranged in rows or in a random pattern and, further, may be located elsewhere in the shell wall 130. Further, the shell wall 130 may include a radially inwardly tapered portion 140 adjacent to the aft end 134 thereof, as shown in FIGS. 4 and 5.

The first fuel injection system 116A comprises a pilot nozzle 200 attached to the cover plate 135 and a plurality of main fuel nozzles 202 also attached to the cover plate 135, see FIG. 4. The first fuel supply structure 116$A_1$ comprising first fuel inlet tubes 216 coupled to the pilot nozzle 200 and the main fuel nozzles 202 as well as to a fuel source 152. The fuel inlet tubes 216 receive fuel from the fuel source 152 and provide the fuel to the pilot and main fuel nozzles 200 and 202. The fuel from the pilot and main fuel nozzles 200 and 202 is mixed with compressed air flowing through the air flow passage 124 and ignited in a combustion chamber 114A within the liner 128 creating combustion products defining a working gas.

Figure 5:
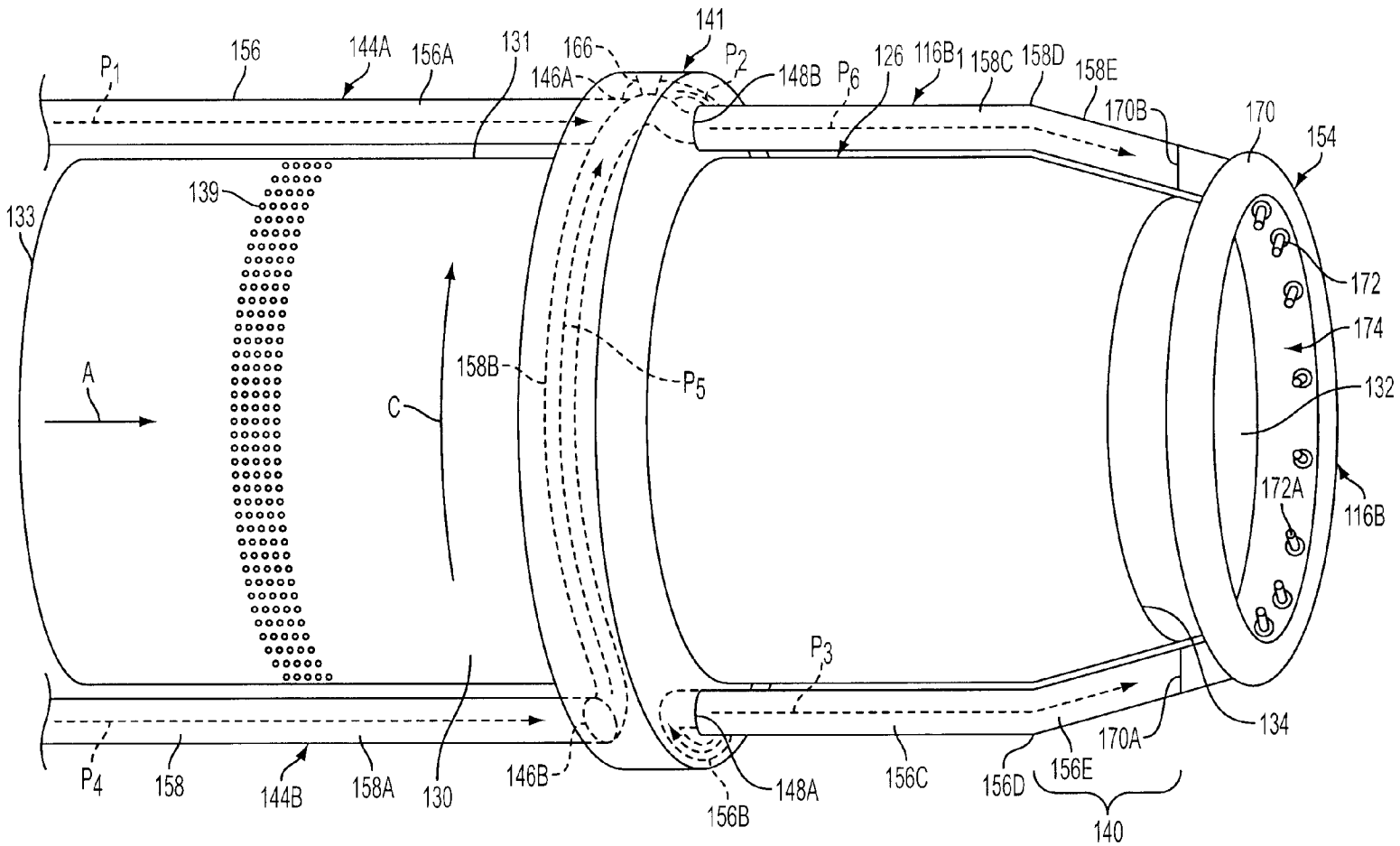
FIG. 5 is a perspective view of the fuel supply system illustrated in FIG. 4 shown removed from the combustor.
Figure 6:
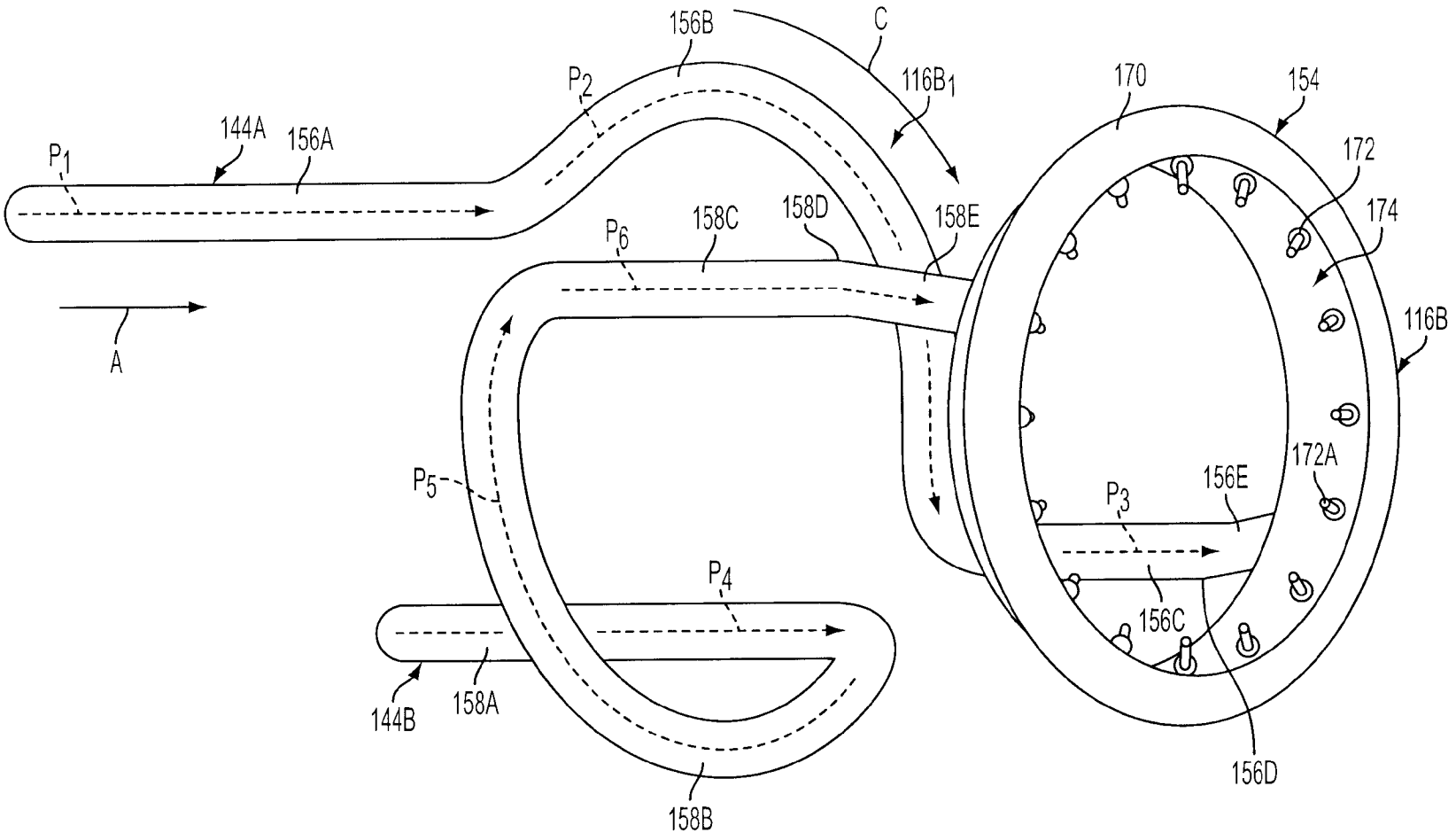
FIG. 6 is a perspective view of a pair of fuel supply structures of the fuel supply system illustrated in FIG. 4 shown removed from the combustor and from a combustor shell of the fuel supply system.

The second fuel injection system 116B is located downstream from the first fuel injection system 116A and comprises an annular manifold 170 coupled to the shell wall aft end 134, such as by welding, see FIGS. 4-6. A plurality of fuel injectors 172 extend radially inwardly from the manifold 170. The fuel injectors 172 extend into an inner volume of the liner 128 so as to inject fuel, via openings 172A, into the liner 128 at a location downstream from the main combustion zone 114A, see FIG. 4. It is noted that injecting fuel in two fuel injection locations, i.e., via the first fuel injection system 116A and the second fuel injection system 116B, may reduce the production of NOx by the combustion system 114. For example, since a significant portion of the fuel, e.g., about 15-25% of the total fuel supplied by the first and second fuel injection systems 116A, 116B, is injected in a location downstream of the combustion chamber 114A, i.e., by the second fuel injection system 116B, the amount of time that the combustion products are at a high temperature is reduced as compared to combustion products resulting from the ignition of fuel injected by the first fuel injection system 116A. Since NOx production is increased by the elapsed time the combustion products are at a high combustion temperature, combusting a portion of the fuel downstream of the combustion chamber 114A reduces the time the combustion products resulting from the fuel provided by the second fuel injection system 116B are at a high temperature such that the amount of NOx produced by the combustion system 114 may be reduced. The fuel injectors 172 may be substantially equally spaced in the circumferential direction about the manifold 170, or may be configured in other patterns as desired, such as, for example, a random pattern. The number, size and locations of the fuel injectors 172 and openings 172A, as well as the dimensions of the annular manifold 170, may vary.

The second fuel supply structure 116$B_1$ communicates with the annular manifold 170 of the second fuel injection system 116B and the fuel source 152 so as to provide fuel from the fuel source 152 to the second fuel injection system 116B, see FIG. 4. The second fuel supply structure 116$B_1$ comprises first and second fuel supply elements 144A, 144B, a second inlet tube 316 and a third inlet tube 318, see FIGS. 4-6. The first fuel supply element 144A comprises a first tubular line 156 having first, second and third sections 156A, 156B and 156C. The first section 156A is coupled to the cover plate 135 and communicates with a fitting 314A, which, in turn, communicates with the second inlet tube 316. The second inlet tube 316 is coupled to the fuel source 152. The first section 156A of the first tubular line 156 extends away from the cover plate 135 along a first path $P_1$ having a component in an axial direction, which axial direction is indicated by arrow A in FIG. 5. The second section 156B extends along a second path $P_2$, which second path $P_2$ has a component in a circumferential direction. The circumferential direction is indicated by arrow C in FIG. 5. In the illustrated embodiment, the second path $P_2$ extends about 90 degrees to the first path $P_1$ and through an arc of about 180 degrees. It is contemplated that the second path $P_2$ may extend through any arc within the range of from about 15 degrees to about 180 degrees. The third section 156C extends along a third path $P_3$ having a component in the axial direction A. In the illustrated embodiment, the third path $P_3$ extends about 90 degrees to the second path $P_2$ and is generally parallel to the first path $P_1$. The third section 156C is coupled to an inlet 170A of the manifold 170. Hence, fuel flows from the fuel source 152, through the second inlet tube 316, the fitting 314A, the first fuel supply element 144A and into the manifold inlet 170A so as to provide fuel to the manifold 170.

The second fuel supply element 144B comprises a second tubular line 158 having fourth, fifth and sixth sections 158A, 158B and 158C. The fourth section 158A is coupled to the cover plate 135 and communicates with a fitting (not shown), which, in turn, communicates with the third inlet tube 318. The third inlet tube 318 is coupled to the fuel source 152. The fourth section 158A of the second tubular line 158 extends away from the cover plate 135 along a fourth path $P_4$ having a component in the axial direction A. The fifth section 158B extends along a fifth path $P_5$, which fifth path $P_5$ has a component in the circumferential direction C. In the illustrated embodiment, the fifth path $P_5$ extends about 90 degrees to the fourth path $P_4$ and through an arc of about 180 degrees. It is contemplated that the fifth path $P_5$ may extend through any arc within the range of from about 15 degrees to about 180 degrees. The sixth section 158C extends along a sixth path $P_6$ having a component in the axial direction A. In the illustrated embodiment, the sixth path $P_6$ extends about 90 degrees to the fifth path $P_5$ and is generally parallel to the fourth path $P_4$. The sixth section 158C is coupled to an inlet 170B of the manifold 170. Hence, fuel flows from the fuel source 152, through the third inlet tube 318, the fitting, the second fuel supply element 144B and into the manifold inlet 170B so as to provide further fuel to the manifold 170.

As shown in FIGS. 2-4, the third and sixth sections 156C and 158C of the first and second tubular lines 156 and 158 include angled parts 156D and 158D. The angled parts 156D and 158D cause end parts 156E and 158E of the third and sixth sections 156C and 158C to bend inwardly so as to follow the radially inwardly tapered portion 140 of the shell wall 130.

During operation of the combustor apparatus 116, the combustor shell wall 130 may thermally expand and contract differently, i.e., a different amount, from that of the annular manifold 170, which is coupled to the aft end 134 of the combustor shell wall 130, as well as differently from that of the second fuel supply structure 116$B_1$. This is because the fuel flowing through the second fuel supply structure 116$B_1$ and the annular manifold 170 functions to cool the second fuel supply structure 116$B_1$ and the annular manifold 170. Hence, during operation of the combustor apparatus 116, the combustor shell wall 130 may reach a much higher temperature than the annular manifold 170 and the second fuel supply structure 116$B_1$. Further, the combustor shell wall 130 may be made from a material with a coefficient of thermal expansion different from that of the material from which the annular manifold 170 and/or the second fuel supply structure 116$B_1$ are made. The different coefficients of thermal expansion and different operating temperatures may result in different rates and amounts of thermal expansion and contraction during combustor apparatus operation and, hence, may contribute to differing amounts of thermal expansion and contraction between the combustor shell wall 130 and the annular manifold 170 and/or the second fuel supply structure 116$B_1$. Because the first and second tubular lines 156 and 158 defining the first fuel supply elements 144A and 144B have angled configurations, i.e., the second and fifth sections 156B and 158B extend substantially laterally to the first, third sections 156A, 156C and the fourth, sixth sections 158A, 158C, the first and second tubular lines 156 and 158 are capable of deflecting as the combustor shell wall 130 and the annular manifold 170/second fuel supply structure 116$B_1$ thermally expand and contract differently. Hence, internal stresses within the first and second tubular lines 156 and 158, which may normally occur if such lines 156 and 158 had only a linear configuration, do not occur or occur at a limited amount during operation of the combustor apparatus 116.

In the illustrated embodiment, a shield structure 141 is affixed to the radially outer surface 131 of the shell wall 130, see FIGS. 4 and 5. The shield structure 141 may be formed separately from and affixed to the shell wall 130, such as by welding, for example, or may be formed integrally with the shell wall 130. Further, the shield structure 141 may comprise one or more separate elements that are coupled together to form the shield structure 141. In the embodiment shown, the shield structure 141 comprises an annular member having a generally U-shaped cross section that extends completely around the shell wall 130. However, it is understood that the shield structure 141 may extend around only a selected portion or portions of the shell wall 130 and may have any suitable shape.

The shield structure 141 defines a protective casing having an inner cavity 142, see FIG. 4. In the illustrated embodiment, the shield structure 141 includes first and second inlet apertures 146A and 146B and first and second outlet apertures 148A and 148B. The first tubular line 156 passes through the first inlet and outlet apertures 146A and 148A such that the second section 156B of the first tubular line 156 is located within the inner cavity 142 of the shield structure. The second tubular line 158 passes through the second inlet and outlet apertures 146B and 148B such that the fifth section 158B of the second tubular line 158 is also located within the inner cavity 142 of the shield structure. The second and fifth sections 156B and 158B of the first and second tubular lines 156 and 158 extend generally transverse to the axial direction at which high velocity compressed air from the compressor passes along and near the outer surface 131 of the combustor shell wall 130 and through the air flow passage 124. The shield structure 141 functions to shield or protect the second and fifth sections 156B and 158B of the first and second tubular lines 156 and 158 from impact by the high velocity compressed air moving along and near the outer surface 131 of the combustor shell wall 130 and passing through the air flow passage 124. If left exposed to the high velocity compressed air, the high velocity air could apply undesirable forces to the second and fifth sections 156B and 158B of the first and second tubular lines 156 and 158, which forces may damage the first and second lines 156 and 158 or create undesirable vibrations in the lines 156 and 158.

The first and second tubular lines 156 and 158 may be secured to the shell wall 130 or the shield structure 141. In the illustrated embodiment, the second and fifth sections 156B and 158B of the first and second tubular lines 156 and 158 are secured to the shield structure 141 at various locations with fasteners 166, see FIGS. 4 and 5. The fasteners 166 preferably restrain the first and second tubular lines 156 and 158 from vibration while allowing a limited amount of motion in the fore-to-aft direction to permit thermal expansion/contraction of the first and second tubular lines 156 and 158, which, as noted above, may occur differently from that of the shell wall 130.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A combustion apparatus in a gas turbine engine comprising: a combustor shell for receiving compressed air;

a first fuel injection system associated with said combustor shell for delivering fuel to a main combustion zone;

a first fuel supply structure in fluid communication with a source of fuel for delivering fuel from the source of fuel to said first fuel injection system;

a second fuel injection system associated with said combustor shell for delivering fuel to a location that is downstream from the main combustion zone;

a second fuel supply structure in fluid communication with the source of fuel for delivering fuel from the source of fuel to said second fuel injection system, said second fuel supply structure comprising a fuel supply tube including a first section extending axially from a cover plate at a forward end of the combustion apparatus to a second section, said second section being downstream from said first section relative to the fuel flow and extending circumferentially from said first section; and a shield structure associated with at least a portion of said second section of said fuel supply tube to substantially shield said second section portion of said fuel supply tube from compressed air.

2. The combustion apparatus according to claim 1, wherein said first section is located between the source of fuel and said second section.

3. The combustion apparatus according to claim 1, wherein said fuel supply tube further comprises a third section located downstream of said second section relative to the fuel flow, said third section extending axially from said second section.

4. The combustion apparatus according to claim 1, wherein said second section extends about 90 degrees from said first section and through an arc of from about 15 degrees to about 180 degrees.

5. The combustion apparatus according to claim 1, wherein said shield structure extends at least partially around said combustor shell and defines a casing having an inner cavity for receiving at least said portion of said second section of said fuel supply tube.

6. The combustion apparatus according to claim 1, wherein said shield structure is separately formed from said combustor shell.

7. The combustion apparatus according to claim 1, wherein said shield structure is integrally formed with said combustor shell.

8. The combustion apparatus according to claim 1, wherein said shield structure comprises an annular shape.

9. The combustion apparatus according to claim 1, wherein said second fuel injection system is positioned in a downstream portion of said combustor shell.

10. The combustion apparatus according to claim 9, wherein said first fuel injection system is positioned in an upstream portion of said combustor shell.

11. The combustion apparatus according to claim 1, wherein said shield structure provides structural support to said fuel supply tube second section so as to reduce vibrations occurring in said fuel supply tube.

12. The combustion apparatus according to claim 11, further comprising at least one fastener that secures said fuel supply tube to said shield structure.

13. The combustion apparatus according to claim 1, wherein said combustor shell is affixed to said cover plate for structurally supporting said combustor shell within the gas turbine engine.

14. The combustion apparatus according to claim 13, wherein both said first fuel supply structure and said second fuel supply structure extend through said cover plate.

15. A combustion apparatus in a gas turbine engine comprising: a cover plate coupled to an outer casing of the gas turbine engine at a forward end of the combustion apparatus;

a combustion liner defining a combustion chamber;

a combustor shell radially outward of said combustion liner for receiving compressed air, said combustor shell affixed to said cover plate for structurally supporting said combustor shell within the gas turbine engine;

a fuel injection system associated with said combustor shell;

a fuel supply structure in fluid communication with a source of fuel for delivering fuel from the source of fuel to said fuel injection system, wherein said fuel supply structure comprises a fuel supply tube including a first section extending in an axial direction and a second section extending from said first section in a circumferential direction, said fuel supply structure extending through said cover plate, wherein said first and said second sections of said fuel supply structure are disposed radially outward of said combustor shell; and a shield structure associated with at least a portion of said second section of said fuel supply tube.

16. The combustion apparatus according to claim 15, wherein said first section of said fuel supply tube is located between the source of fuel and said second section of said fuel supply tube.

17. The combustion apparatus according to claim 15, wherein said first section of said fuel supply tube extends through said cover plate and said second section of said fuel supply tube extends about 90 degrees from said first section path and through an arc of from about 15 degrees to about 180 degrees.

18. The combustion apparatus according to claim 15, wherein said shield structure extends about said combustor shell and defines a casing having an inner cavity for receiving at least said portion of said second section of said fuel supply tube.

19. A combustion apparatus in a gas turbine engine comprising:

a combustor shell for receiving compressed air;

a fuel injection system that distributes fuel to a location that is downstream from a main combustion zone defined by a combustion liner;

a fuel supply structure in fluid communication with a source of fuel for delivering fuel from the source of fuel to said fuel injection system, said fuel supply structure comprising a fuel supply tube including a first section extending in an axial direction from a cover plate at a forward end of the combustion apparatus to a second section located downstream from said first section relative to the fuel flow and extending from said first section in a circumferential direction, said second section path extending only through an arc of from about 15 degrees to about 180 degrees; and a shield structure associated with at least a portion of said second section of said fuel supply tube to substantially shield said second section portion of said fuel supply tube from compressed air.

20. The combustion apparatus according to claim 19, wherein said second section extends about 90 degrees from said first section.

* * * * *